United States Patent [19]

Campbell et al.

[11] 4,250,900

[45] Feb. 17, 1981

[54] CIGARETTE FILTER HOLDERS WITH OPTIONAL SNORKEL BYPASS ACCESSORY

[76] Inventors: Robert A. Campbell, c/o George Spector, 3615 Woolworth Bldg., 233 Broadway; George Spector, 3615 Woolworth Bldg., 233 Broadway, both of New York, N.Y. 10007

[21] Appl. No.: 905,474

[22] Filed: May 12, 1978

[51] Int. Cl.[3] ..... A24F 13/02

[52] U.S. Cl. ..... 131/189; 131/187; 131/223

[58] Field of Search ..... 131/187, 189, 188, 200, 131/215 R, 215 B, 199, 223, 170 R, 144, 261

[56] References Cited

U.S. PATENT DOCUMENTS

| | | | |
|---|---|---|---|
| 188,992 | 3/1977 | Tiedmann | 131/189 X |
| 895,568 | 8/1908 | Lev | 131/189 |
| 2,869,558 | 1/1959 | Redford | 131/187 |
| 3,026,881 | 3/1962 | Canan | 131/144 |
| 3,211,158 | 10/1965 | Shih et al. | 131/215 R X |
| 3,713,452 | 1/1973 | D'Elin et al. | 131/215 B |

*Primary Examiner*—Stephen C. Pellegrino

[57] ABSTRACT

A cigarette holder that selectively permits a smoker to draw either fully filtered smoke or else unfiltered smoke; the holder including a snorkel tube clipped to an aide of the cigarette holder, a forward end of the snorkel tube being impalled in a side of the cigarette forwardly of the cigarette filters, and a rear end of the snorkel tube being aligned alongside the cigarette holder mouthpiece so to permit the holder in a modified design thereof including a tongue-controlled valve so to draw either through the holder or the snorkel; and the holder in a further modified design including a means for injecting into the smoke stream desired elements such as menthol vapors, various gases, talc or clay powders, and the like.

6 Claims, 15 Drawing Figures

Fig. 1
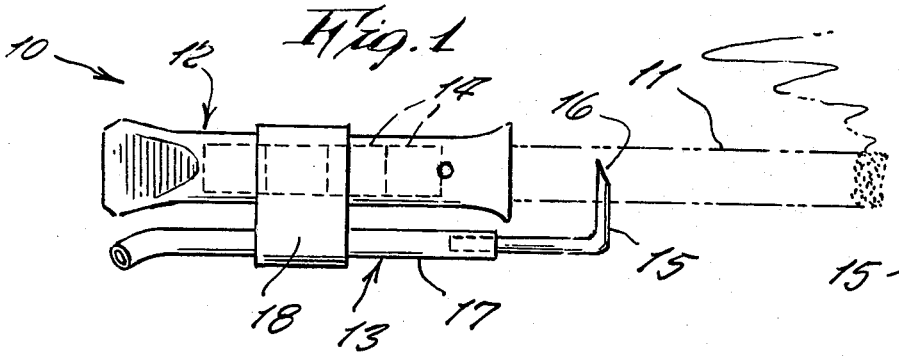
Fig. 2
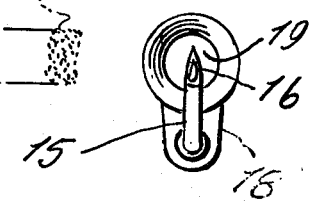
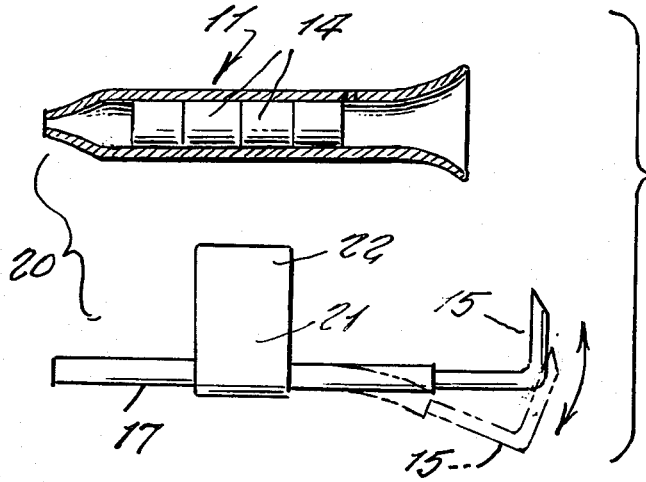
Fig. 3
Fig. 4
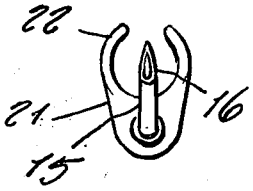
Fig. 5
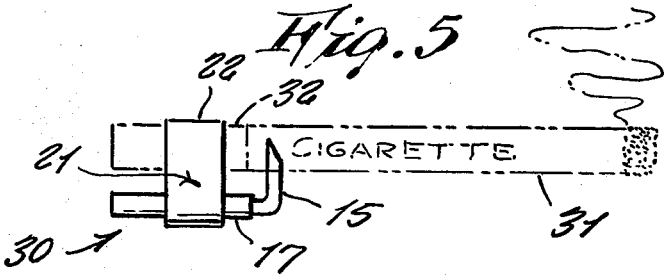
Fig. 6
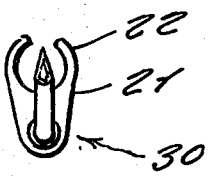
Fig. 8
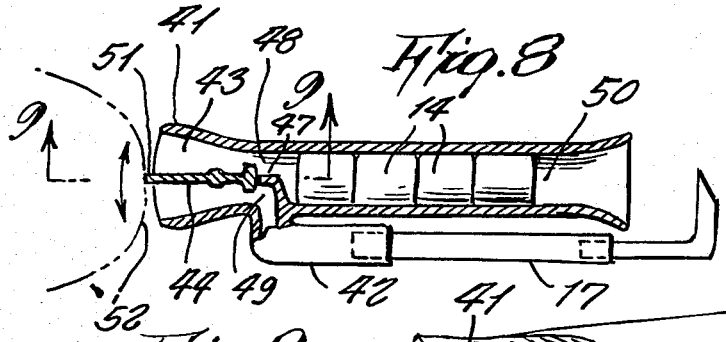
Fig. 7
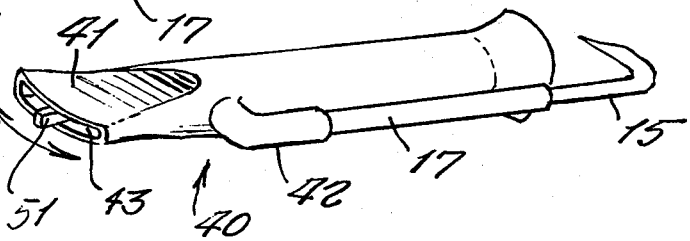
Fig. 9
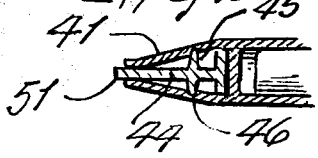

CIGARETTE FILTER HOLDERS WITH OPTIONAL SNORKEL BYPASS ACCESSORY

This invention relates generally to cigarette holders.

A principal object of the present Inventions is to provide a cigarette holder that includes an optional snorkel bypass accessory incorporated therewith and which allows a smoker to draw either a fully filtered puff or else of fully strong unfiltered puff of smoke while smoking a cigarette.

Another object is to provide a cigarette filter holder which accordingly gives a more satisfactory pleasure to a smoker by allowing him upon occassion to get the full unadultereted taste of a raw smoke, while at a remainder of the time he utilizes the benefits of cigarette filters so to not harm his health.

Yet other objects are to provide a cigarette filter holder with optional snorkel bypass accessory which is economical to construct and will function efficiently as desired.

These and other objects will become apparent from the attached drawings and accompanying specifications.

FIG. 1 is a side view of a combination filter cigarette holder and optional snorkel, made either attached together or made integrally together.

FIG. 2 is a front end view of the device seen in FIG. 1.

FIG. 3 is a side view of a replacable cigarette holder and a bypass filter snorkel which are either attachable together, or the holder can be used along without the snorkel.

FIG. 4 is a front end view of the snorkel seen in the lower portion of FIG. 3.

FIG. 5 is a side view of a snorkel for use with a filtered cigarette.

FIG. 6 is a front end view the snorkel device seen in FIG. 5.

FIGS. 7, 8 and 9 illustrate views of still another design of a combination filter cigarette holder and snorkel in which the smoker does not have to change his lips from one to the other, because both can be drawn from the same mouthpiece, due to a pivotable valve controlled to move by a tip of a tongue so to selectively open or close either air passage; FIGS. 7 and 8 showing the valve in an intermediate position so that both passages are partly open and thus let a little of each to be drawn in.

Figure 10:
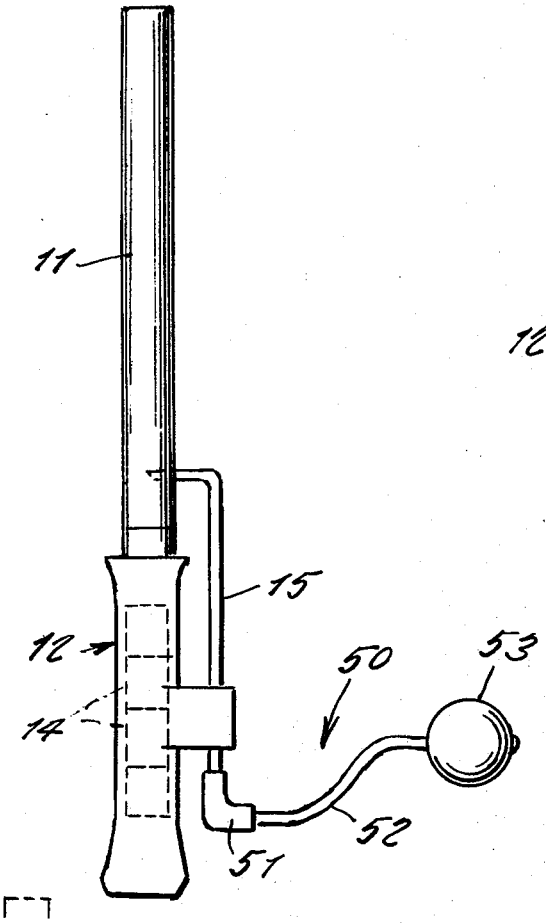

FIG. 10 illustrates a modified design of the Invention wherein a bulb pump is attached to the snorkel, the design being incorporated into a holder containing filters such as its shown in FIG. 1, and fitted with cigarette.

Figure 11:
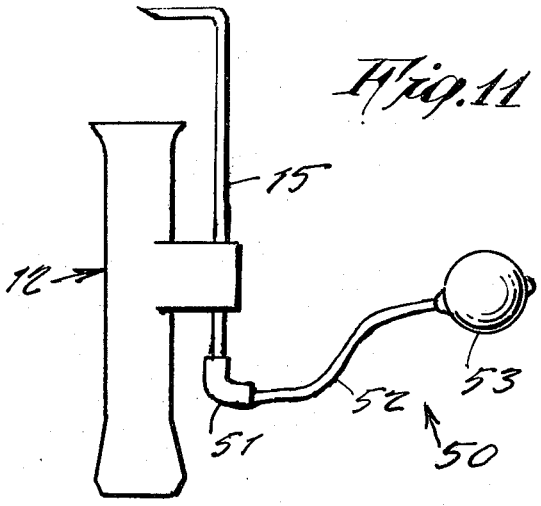

FIG. 11 is a similar view of the device seen in FIG. 10 shown without the cigarette.

Figure 12:
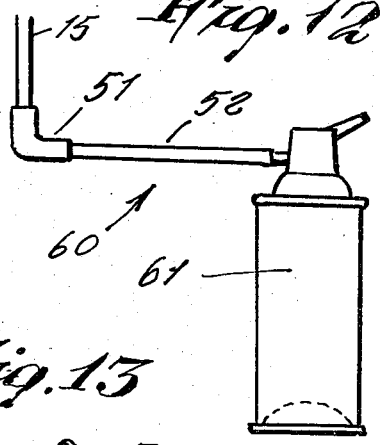

FIG. 12 is a modified design of snorkel extension attached to a pressure can containing an additive for the snorkel smoke.

Figure 13:
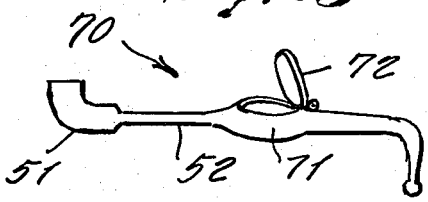

FIG. 13 is another modified design of snorkel extension that includes a pot in which additives may be placed for mixing with the snorkel smoke.

Figure 14:
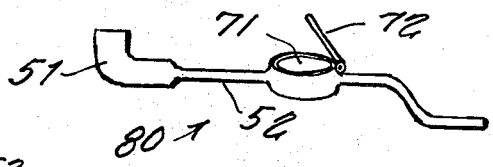

FIG. 14 is a perspective view of a modification of the snorkel extension of FIG. 13.

Figure 15:
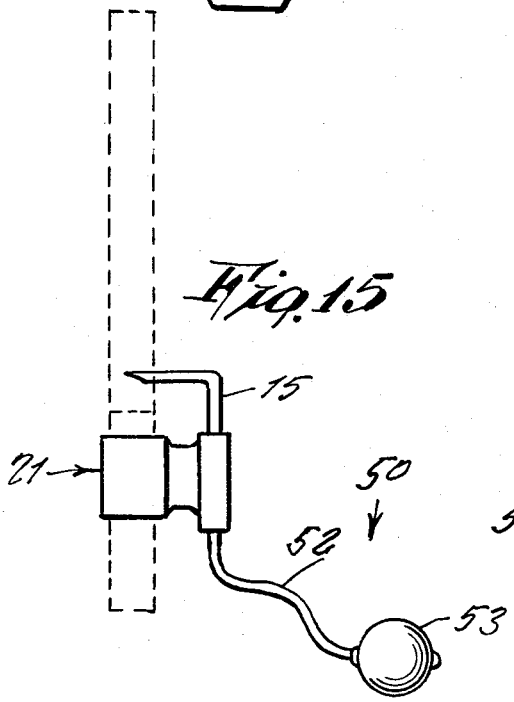

FIG. 15 is another modified design of the invention wherein the bulb pump is attached to a snorkel of a holder that does not carry its own filters, such as shown in FIG. 5.

Referring now to the drawing in greater detail, and more particularly to FIGS. 1 and 2 thereof at this time, the references numeral 10 represents a cigarette filter holder with optional snorkel bypass accessory according to the present invention and which is designed for use with an ordinary cigarette 11, having no built-in filter. The device 10 includes a cigarette filter holder 12 and a snorkel bypass accessory 13 which may be made either integral with the holder or else be fitted thereupon.

The holder 12, molded of a hard plastic, is flared at a forward end so to easily receive the cigarette, while the rear end thereof is flattened so to serve as a bit or mouthpiece for placement in a mouth. Various combinations of filter plugs 14 are fitted inside a center of the holder for filtering smoke passing therethrough. The filters 14 may include end plugs of cellulose acetate bilaments and center plugs of activated charcoal or powdered metal.

The accessory 13 includes an angle-shaped snorkel tube 15, made of hard plastic, and which has a point 16 at one end for insertion through a side of the cigarette, while the other end is fitted in one end of a flexible hose 17 which at its other end aligns with the holder mouthpiece. The hose is held at its center in a hard plastic fitting 18 having a circular opening 19 for being fitted around the center of the holder 12. To impale the snorkel in a cigarette, the hose is sidewardly flexed as shown by dotted lines in FIG. 3.

In operative use, a smoker selectively puffs on either the holder mouthpiece for a filtered smoke or on the snorkel hose for an unfiltered smoke, as wished.

In FIGS. 3 and 4, a modified design of the invention 20 is a same as the above described device 10 except that the snorkel accessory is removable from the holder, due to the accessory fitting 21 having a clip 22 instead of the above described opening 19. Accordingly the holder may be of disposable type that is replacable after the filters are worn out.

In FIGS. 5 and 6, another modified design of the invention 30 is for use on a filtered cigarette 31 having its own built-in filters. It includes the snorkel tube 15 fitted in a relatively short length of hose 17 so that the snorkel point 16 can be still be impalled in the cigarette forwardly of the cigarette filter 32, due to the fitting 21 being clipped directly around the filter of the cigarette. In this design, the fitting 21 itself receives the cigarette so to act as a cigarette holder.

In FIGS. 7, 8 and 9, still another design of cigarette filter holder with optional bypass accessory 40 is illustrated which is similar to above-described device 10 except that the rear end of the hose 17 is connected with the holder mouthpiece 41 instead being separated from the mouthpiece, the hose being attached to a pipe 42 formed integrally on a side of the holder, so that the smoke from the snorkel is drawn directly into the mouthpiece chamber 43. A valve 44 pivotable about projections 45 seated in depressions 46 serves to selectively close either port 48 of the pipe 42 or close a port 49 of the holder duct 50 that has the filters 14 placed therein. The valve has an end 51 extending slightly outward of the mouthpiece so that the valve may be manually controlled and flipped, in either direction by a persons tongue 52. Thus the selective control is done entirely inside the mouth and does not require removal of the device from the mouth while making a change. Additionally this design permits selective blending of more or less raw smoke with the filtered air, as prefered at each puff, instead of only either a full filtered or full unfiltered smoke. Thus as shown in FIG. 8, the valve aligned with a partition 47 between the ports 48 and 49, is in a neutral position and allows fully both filtered and unfiltered smoke to enter the smokers mouth as a mixture or blend.

Referring now to FIGS. 10 through 15, another design of the invention includes a means for injecting, inserting or infiltrating additives of various kinds into the snorkel smoke stream. Such additives may comprise either solids, liquids or gases such as menthol vapor, gases such as helium, oxygen or carbon dioxide, powders of talc or clay and the like, and which will give a refreshing new taste to a smoker. This is accomplished by an attachment mounted on the rear end of the snorkel tube, and which is an optional feature.

In FIGS. 10, 11 and 15 this comprises a snorkel attachment 50 consisting of elbow 51, attachable at one end to the snorkel, the other end of the elbow being integral with flexible hose 52 connected to squeezable bulb pump 53.

It should be noted that in the design shown in FIG. 15, the hose 52 can be attached directly to the fitting 21 without use of the elbow 51, as suggested.

In operative use, when the bulb pump is squeezed, additives entering the hose 52 are passed through the snorkel tube 15 up into the cigarettes where they are mixed with a smoke of the cigarette that thereafter moves through the holder 12 or fitting 21 and into the smokers mouth.

In FIG. 12 a modified design thereof comprises a snorkel attachment 60 includes elbow 51 and hose 52 which is connected to an aerosol can 61 from which vaporized additives can be admitted into the cigarette.

In FIGS. 13 and 14 different designs of snorkel attachments 70 and 80 each include elbow 51 and hose 52 which is designed with a pot 71 closable by hinged cover 72, the pot being able to receive additives for moving into the cigarette as above described.

While various changes may be made in the detail construction, it is understood that such changes will be within the spirit and scope of the present invention as in defined by the appended claims.

What is claimed is:

1. An article of manufacture comprising in combination a cigarette holder having a mouthpiece with a passageway and a snorkel bypass accessory means, said accessory means being supported by said holder, said holder having a tubular opening therethrough, adapted to receive a filtered cigarette end, said accessory means including means including a flexible snorkel tube having a pointed end for insertion in a side of said cigarette forwardly of said holder, said accessory means providing means for inhaling smoke forward of said holder bypassing said cigarette filtered end, whereby said article can be used for inhaling unfiltered smoke from said snorkel and filtered smoke from said cigarette.

2. The combination as set forth in claim 1 wherein said accessory means comprises a duct combined with said mouthpiece passageway and connected to said flexible snorkel tube forming dual routes to the users mouth.

3. The combination as set forth in claim 2, including a pivotable valve inside said mouthpiece movable to selectively chose said duct or said passageway or to a position opening said duct and said passageway and having an end of said valve extending outwardly of said mouthpiece chamber for being pivotably controlled by a person's tongue.

4. The combination as set forth in claim 1 wherein a snorkel attachment is removably fitted on a rear end of said snorkel tube, said attachment including an elbow fitted on said snorkel tube, a flexible hose integral with said elbow, and means connected to said hose for moving additives forwardly into said snorkel tube and into a cigarette held in said holder.

5. The combination as set forth in claim 4, wherein said means connected to said hose comprises a squeezable bulb pump applied on an end of said hose.

6. The combination as set forth in claim 4, wherein said means connected to said hose comprises a pot formed along said hose for receiving said additives, said pot being closable by a hinged cover.

* * * * *